US009291011B2

(12) United States Patent
DeBerry

(10) Patent No.: US 9,291,011 B2
(45) Date of Patent: Mar. 22, 2016

(54) INTEGRAL DIVERTER SYSTEM

(71) Applicant: Blake T. DeBerry, Houston, TX (US)

(72) Inventor: Blake T. DeBerry, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 701 days.

(21) Appl. No.: 13/662,141

(22) Filed: Oct. 26, 2012

(65) Prior Publication Data

US 2014/0116700 A1 May 1, 2014

(51) Int. Cl.

| | |
|---|---|
| ***E21B 33/03*** | (2006.01) |
| ***E21B 33/04*** | (2006.01) |
| ***E21B 33/038*** | (2006.01) |
| ***E21B 21/01*** | (2006.01) |

(52) U.S. Cl.

CPC ..... *E21B 21/01* (2013.01); *E21B 33/03* (2013.01); *E21B 33/038* (2013.01); *E21B 33/04* (2013.01)

(58) Field of Classification Search

CPC ..... E21B 21/106; E21B 33/03; E21B 33/04; E21B 33/038

See application file for complete search history.

(56) References Cited

U.S. PATENT DOCUMENTS

| | | | | |
|---|---|---|---|---|
| 2,546,638 | A * | 3/1951 | Humason | 166/88.1 |
| 3,137,348 | A * | 6/1964 | Ahlstone et al. | 166/348 |
| 2006/0283633 | A1 * | 12/2006 | Benge et al. | 175/57 |

* cited by examiner

*Primary Examiner* — Cathleen Hutchins

(74) *Attorney, Agent, or Firm* — Baker Botts L.L.P.

(57) ABSTRACT

An integral diverter system for diverting drilling fluid returns into flowlines connected to outlets for return to the drilling fluid reservoirs or other desirable locations is disclosed. The diverter assembly includes a lower tubular body that is coupled to a conductor and an upper tubular body having one or more diverter flow outlets, and one or more additional outlets. A connecting means secures the lower tubular body to the upper tubular body. One or more additional packer elements are disposed within the upper tubular body and locking means are provided for securing the one or more additional packer elements in position within the upper tubular body.

32 Claims, 6 Drawing Sheets

INTEGRAL DIVERTER SYSTEM

BACKGROUND

Diverter systems may be used in conjunction with performance of subterranean operations which involve retrieval of hydrocarbons from subterranean formations. Diverter systems are traditionally fixed to the bottom of rotary beams of a drilling rig, below the rig floor. The purpose of a diverter system is to provide low pressure control over a well by diverting well fluids away from the drilling rig when performing subterranean operations such as, for example, during the preliminary stages of drilling. A typical diverter system may include a housing supported with its bore beneath the rotary table on the platform, and having one or more side outlets from the bore for connection with drilling mud return lines on the platform. A typical diverter system may also include a diverter assembly. A typical diverter assembly may include a tubular body adapted to be lowered into a supported position in the bore of the housing. The tubular body may have one or more ports each aligned with a corresponding side outlet from the bore. The typical diverter assembly also may include a spool, having an overshot packer at its lower end. The spool may be suspended from the tubular body for lowering over the upper end of a conductor extending upwardly from the preventer stack as the tubular body is landed in the bore of the housing. More particularly, the tubular body may be sealingly coupled to the housing bore to confine flow within the tubular body into the side outlets with flow normally returning to the rig mud system from which it may be recirculated into the drill string.

Packers may be adapted to be lowered into and landed in the diverter body to seal about a drill string extending downwardly from the rotary table and through the tubular body leading to the conductor. Accordingly, drilling fluid returns may run through the drill string and be "diverted" into overboard lines connected to the outlets in the housing with reservoirs on the platform.

Prior art systems of this type are traditionally used in marine drilling rigs, particularly with floating drilling equipment. In certain applications, it may be desirable to adapt diverter systems to be used with land rigs. It may also be desirable to reduce the costs associated with traditional diverter systems by coupling the diverter assembly to the conductor, thus eliminating the need for a housing.

SUMMARY OF THE INVENTION

The present invention relates generally to a diverter apparatus and system for drilling rigs, and more particularly, in certain embodiments, to an integral diverter system for diverting drilling fluid returns into flowlines connected to outlets for return to the drilling fluid reservoirs or other desirable locations.

In one embodiment, the present disclosure is directed to a diverter assembly for performance of subterranean operations comprising: a lower tubular body, wherein the lower tubular body is operable to couple to a conductor; an upper tubular body having one or more diverter flow outlets, and one or more additional outlets; a connecting means, wherein the connecting means secures the lower tubular body to the upper tubular body; one or more additional packer elements disposed within the upper tubular body; and locking means for securing the one or more additional packer elements in position within the upper tubular body.

In accordance with another embodiment, the present disclosure is directed to a diverter assembly for performance of subterranean operations comprising: a tubular body with a lower end and an upper end having an overshot packer at the lower end and one or more diverter flow outlets, one or more additional outlets, and a main packer at the upper end, wherein the tubular body is operable to couple to a conductor; one or more additional packer elements at the upper end of the tubular body; and locking means for securing the one or more additional packer elements in position within the upper end of the tubular body.

In certain embodiments, the present disclosure is directed to an integral diverter system comprising: a conductor extending upwardly from a wellhead; a diverter assembly coupled to the conductor, the diverter assembly comprising: a lower tubular body having an overshot packer, wherein the lower tubular body couples the conductor to the diverter assembly; an upper tubular body having one or more diverter flow outlets, one or more additional outlets, and a main packer; a connecting means, wherein the connecting means couples the lower tubular body to the upper tubular body; one or more additional packer elements disposed within the upper tubular body; locking means for securing the one or more additional packer elements in position within the upper tubular body; and a conduit run through the conductor; wherein the main packer comprises an inwardly inflatable rubber sleeve; wherein the innermost packer element forms a low pressure seal about the conduit; and wherein a fluid flowing through an annulus between the conduit and the conductor or through the conduit may be selectively directed to at least one of the one or more diverter flow outlets and the one or more additional outlets.

In accordance with certain embodiments, the present disclosure is directed to an integral diverter system comprising: a conductor extending upwardly from a wellhead; a diverter assembly coupled to the conductor, the diverter assembly comprising: a tubular body with a lower end and an upper end having an overshot packer at the lower end and one or more diverter flow outlets, one or more additional outlets, and a main packer at the upper end, wherein the tubular body is operable to couple to a conductor; one or more additional packer elements at the upper end of the tubular body; and locking means for securing the one or more additional packer elements in position within the upper end of the tubular body; a conduit, wherein the conduit runs through the conductor; wherein the main packer comprises an inwardly inflatable rubber sleeve; wherein the innermost packer element forms a low pressure seal about the conduit; and wherein a fluid flowing through the conduit or an annulus between the conduit and the conductor may be selectively directed to at least one of the one or more diverter flow outlets and the one or more additional outlets.

In accordance with certain embodiments, the present disclosure is directed to a method of installing an integral diverter system comprising: coupling a diverter assembly to a conductor with an attaching means; directing a drill string having a drill bit at its lower end downhole through the conductor; removing the drill string; running a casing pipe through the conductor and diverter assembly; cementing the casing pipe in place; running one or more additional casing pipes through the conductor and diverter assembly; and cementing the one or more additional casing pipes in place.

The features and advantages of the present invention will be readily apparent to those skilled in the art. While those skilled in the art may make numerous changes, such changes are within the spirit of the invention.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and are not exhaustive of the scope of the disclosure.

DETAILED DESCRIPTION OF THE DRAWINGS

Illustrative embodiments of the present disclosure are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells.

The terms "couple" or "couples" as used herein are intended to mean either an indirect or direct connection. Thus, if a first device couples to a second device, that connection may be through a direct connection, or through an indirect mechanical or electrical connection via other devices and connections.

The present invention relates generally to a diverter apparatus and system for drilling rigs, and more particularly, in certain embodiments, to an integral diverter system for diverting drilling fluid returns into flowlines connected to outlets for return to a drilling fluid reservoir or other desirable locations.

Figure 1:
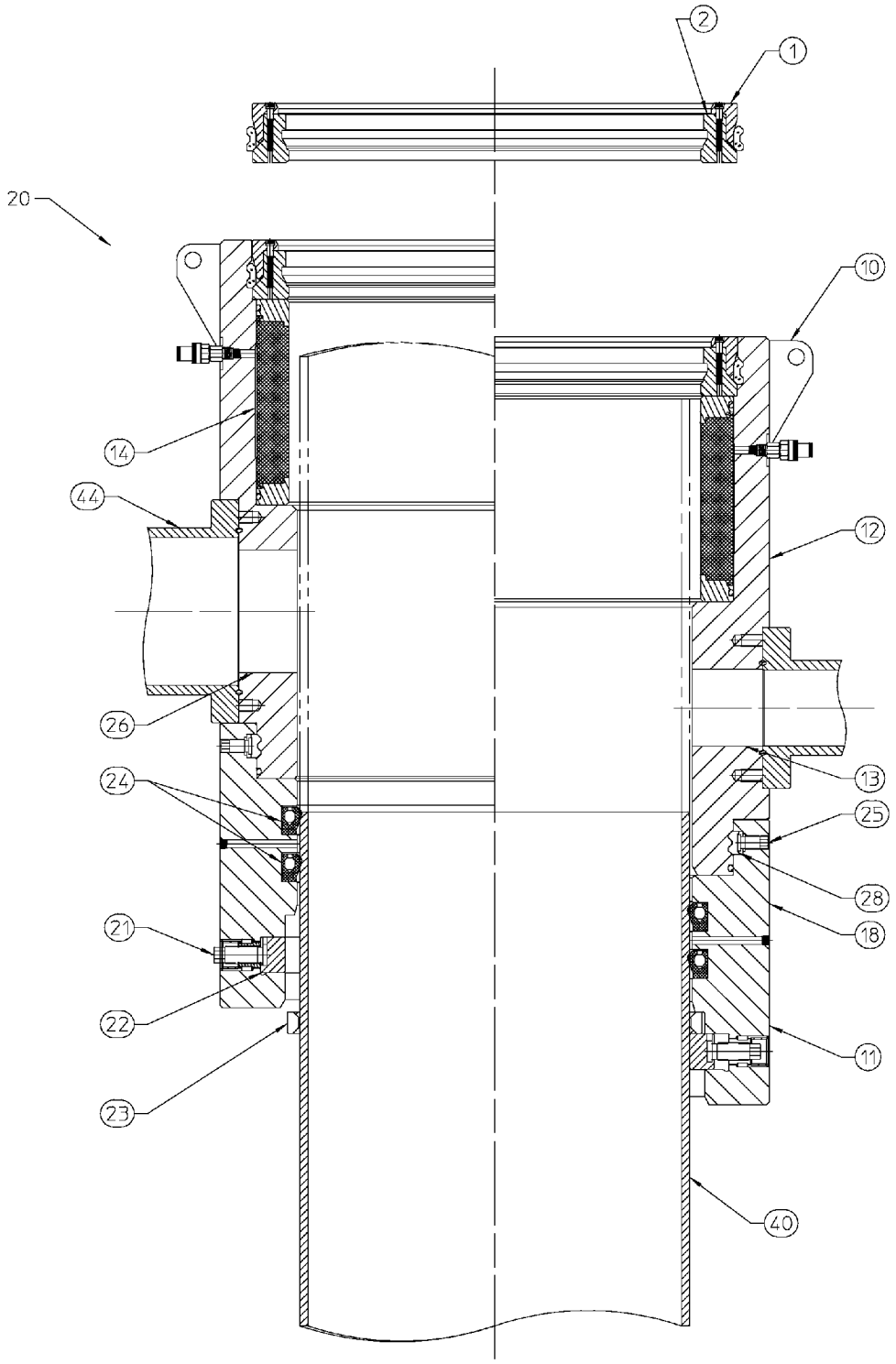
FIG. 1 illustrates a vertical sectional view of an integral diverter system installed beneath a rotary table of a rig floor in accordance with certain embodiments of the present disclosure.
Figure 6:
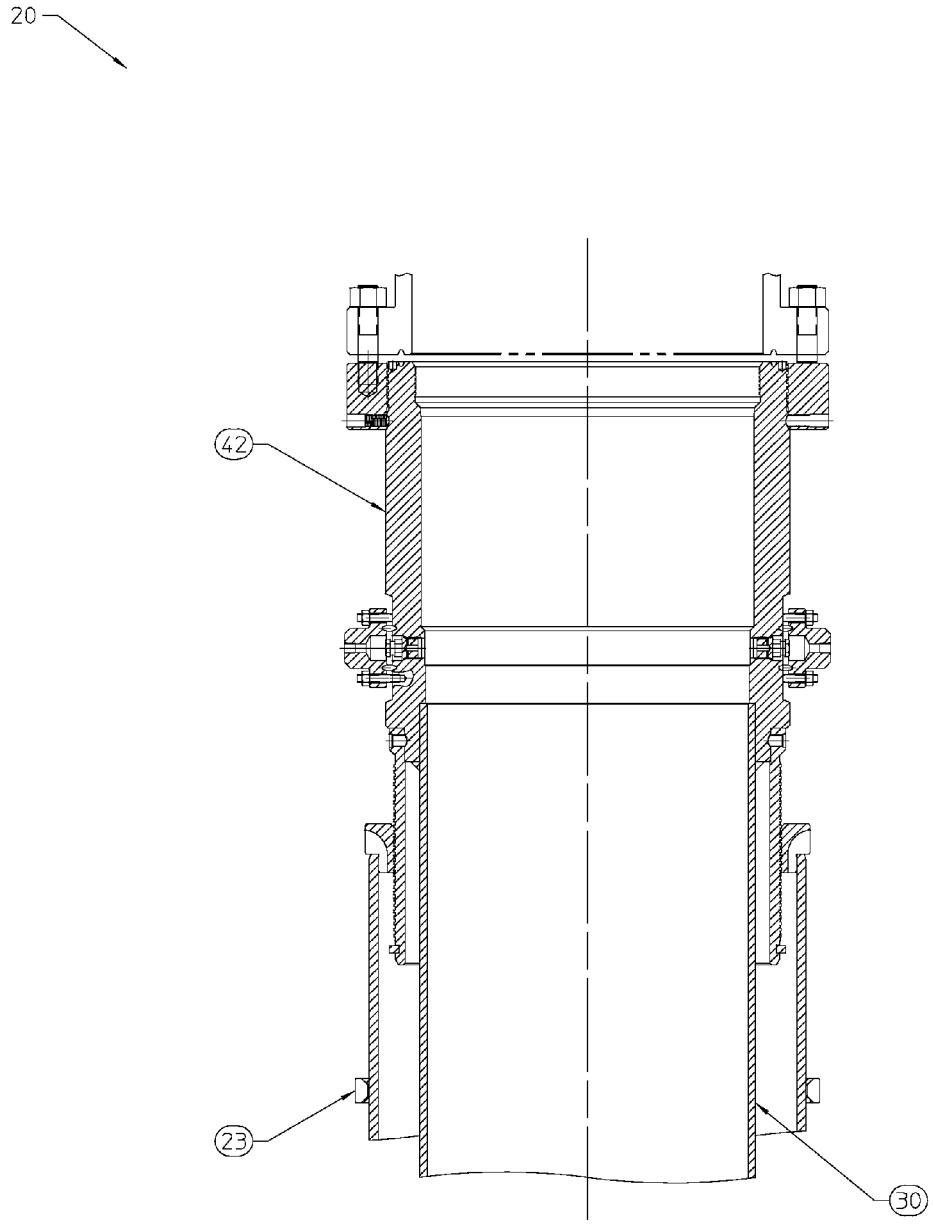
FIG. 6 illustrates a vertical sectional view of the integral diverter showing the casing pipe disposed within the wellhead.

Referring to FIG. 1, an integral diverter system in accordance with an illustrative embodiment of the present disclosure is denoted generally with reference numeral 20. In certain implementations, the integral diverter system 20 may be located beneath a rotary table 2 on the rig floor 1. The integral diverter system 20 may include a conductor 40 having a bore therethrough that extends upwardly from the wellhead 42 (shown in FIG. 6) into the integral diverter system 20. In certain embodiments, the conductor 40 may be cut and prepared at the surface before being installed downhole. The integral diverter system 20 may further include a diverter assembly 10, installed proximate to an upper portion of the conductor 40.

In certain embodiments, the diverter assembly 10 may include a lower tubular body 11 and an upper tubular body 12, each having a bore therethrough which may house the conductor 40. The diameter of the bore of the lower tubular body 11 and the diameter of the bore of the upper tubular body 12 may or may not be the same. The diameter of the bore of the lower tubular body 11 may vary in size to accommodate various sizes of conductors 40. Accordingly, the lower tubular body 11 may be interchangeable as desired to accommodate different size conductors depending on the system requirements. As would be appreciated by those of ordinary skill in the art, having the benefit of the present disclosure, the lower tubular body 11 and the upper tubular body 12 may be made from any suitable material including, but not limited to, steel.

Figure 2:
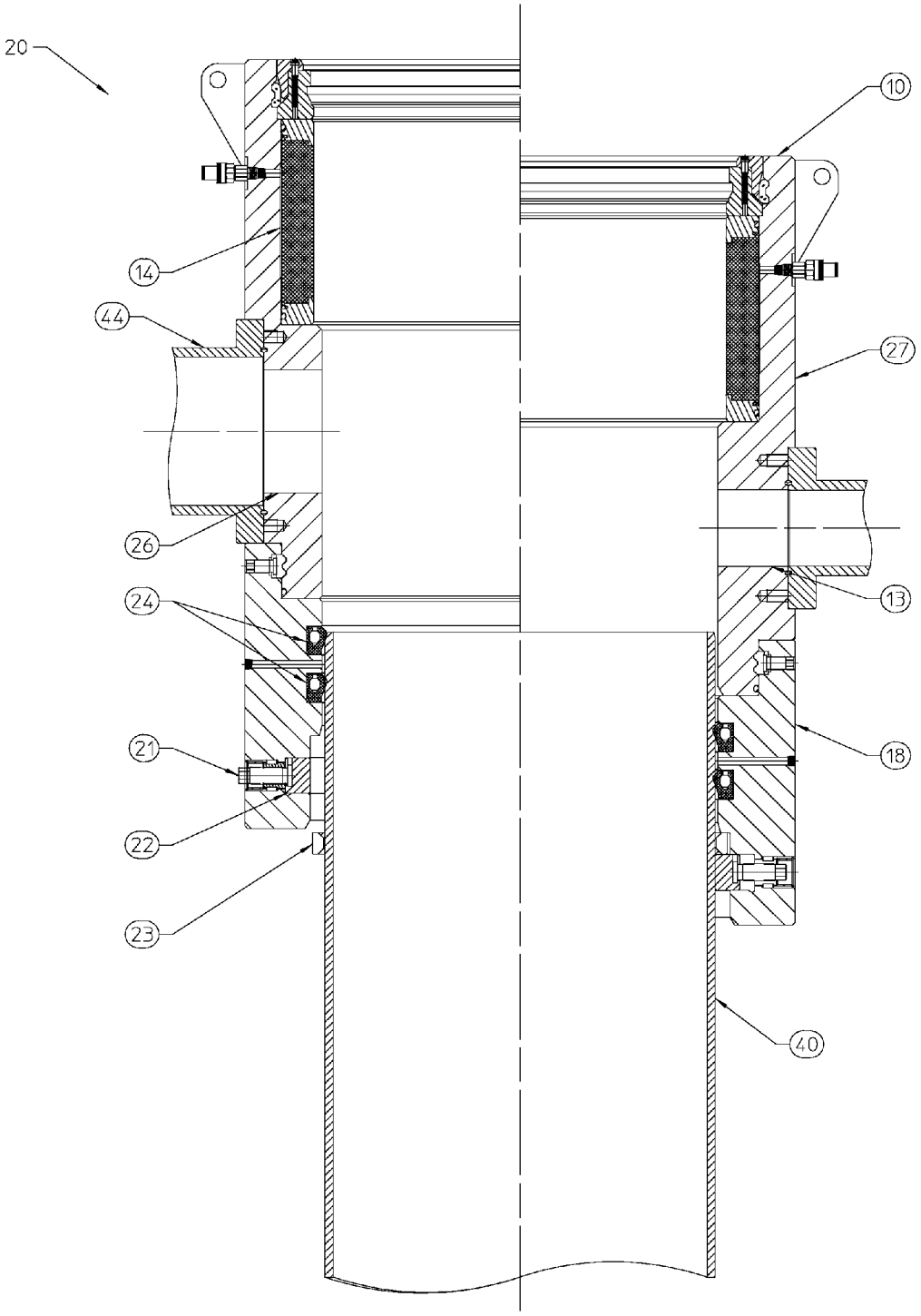
FIG. 2 illustrates a vertical sectional view of an integral diverter system showing a diverter assembly having a single-piece tubular body installed directly onto a conductor, in accordance with certain embodiments of the present disclosure.
Figure 3:
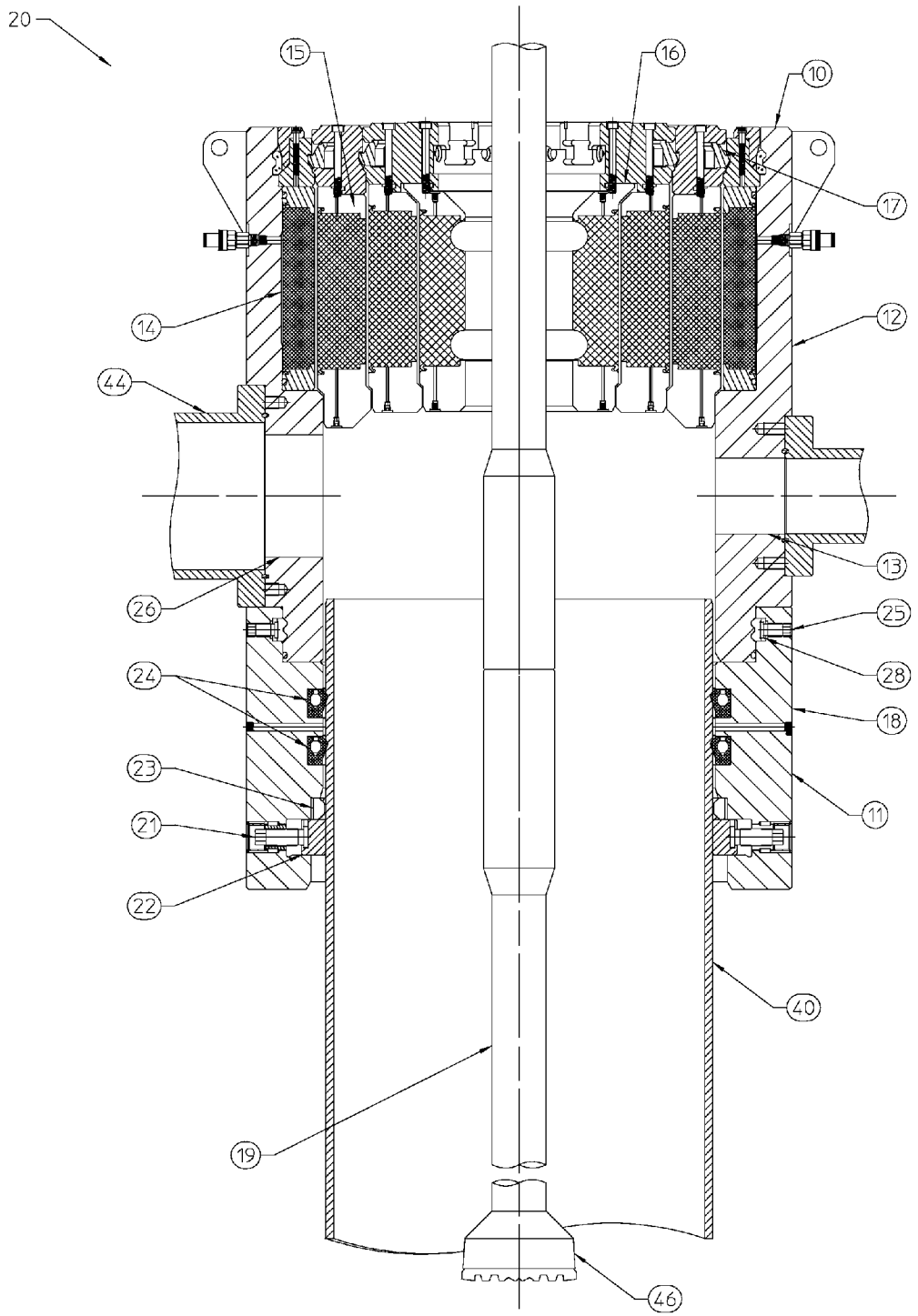
FIG. 3 illustrates a vertical sectional view of an integral diverter system showing a diverter assembly installed directly onto a conductor, and a drill string run through the conductor, in accordance with certain embodiments of the present disclosure.
Figure 4:
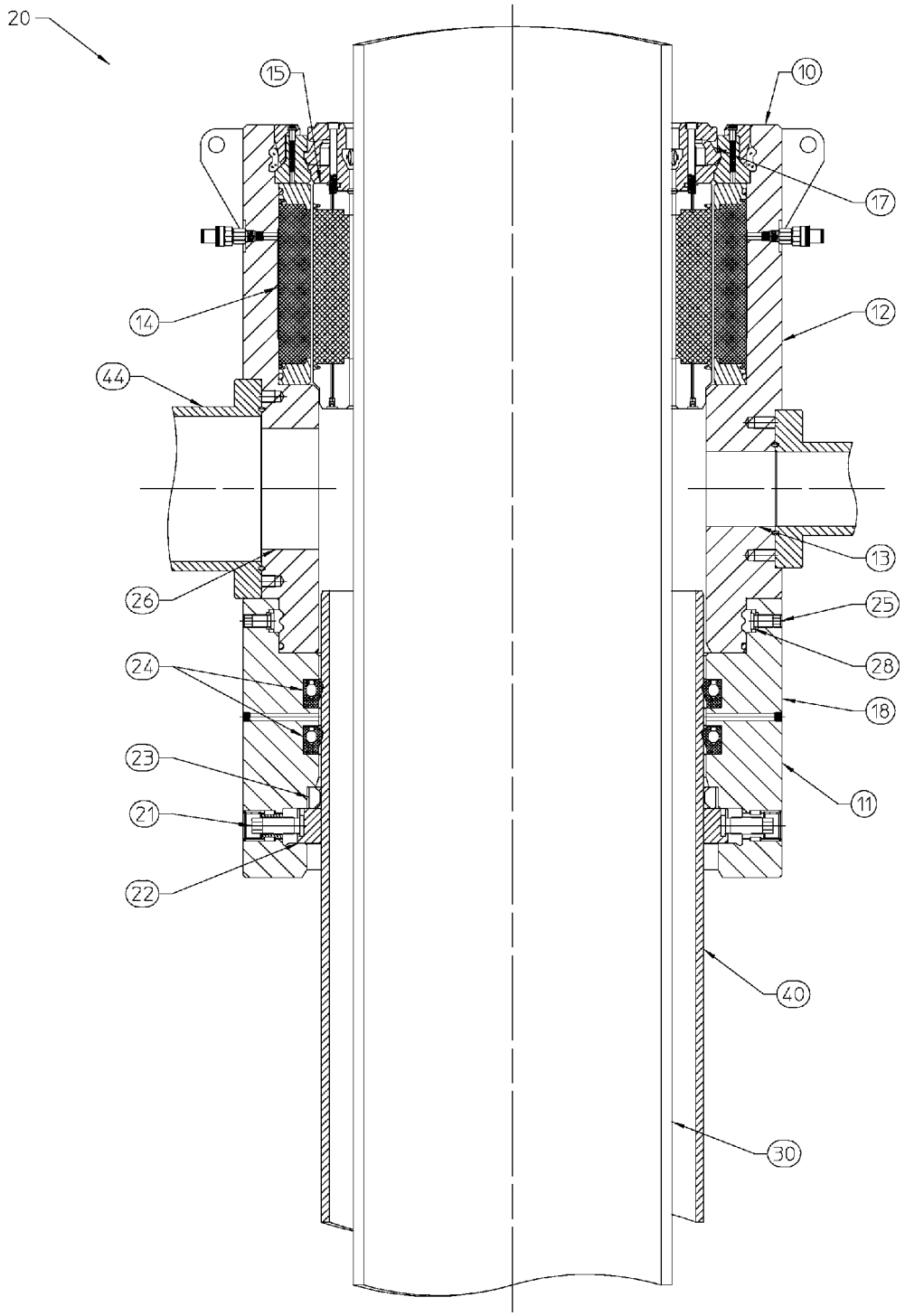
FIG. 4 illustrates a vertical sectional view of an integral diverter system showing the diverter assembly installed directly onto a conductor and a casing pipe run through the conductor, in accordance with certain embodiments of the present disclosure.

In certain implementations, the lower tubular body 11 may include an overshot packer 18 sealably engaged about the upper end of the conductor 40. The upper tubular body 12 may include one or more diverter flow outlets 13. The diverter flow outlets 13 permit flowlines 44 to be connected thereto, as shown in FIGS. 2-4. Fluids flowing through the conductor 40 may be directed to the diverter flow outlets 13 and away from the rig through flowlines 44 connected thereto. The upper tubular body 12 may further include one or more additional outlets as may be desired. For example, but not by way of limitation, the upper tubular body 12 may include a mud pit outlet 26 adapted to permit flowlines 44 to be connected thereto to direct fluids to a mud pit (not shown). The upper tubular body 12 may further include a main packer 14, which in certain implementations may comprise an inwardly inflatable rubber sleeve. In certain embodiments, the main packer 14 may be inwardly contractible in response to the supply of fluid pressure to an outer side thereof.

As shown in FIG. 1, the lower tubular body 11 and the upper tubular body 12 may be coupled via a connecting means 25. Any suitable connecting means known to those of ordinary skill in the art may be used to couple the lower tubular body 11 and the upper tubular body 12. For instance, the connecting means 25 may include, but is not limited to, actuator screws, dogs, slips, split rings, bolts, grips, threads, flanges, welding, or any other suitable connecting means known to those of ordinary skill in the art. FIG. 1 shows the lower tubular body 11 and the upper tubular body 12 connected by one or more bolt connections 25 at the upper end of the lower tubular body 11. In certain embodiments, the bolt connection 25 may comprise a dog segment 28. However, those skilled in the art will appreciate other suitable configurations may be used without departing from the scope of the present disclosure.

Referring now to FIG. 2, in another embodiment in accordance with the present disclosure, the diverter assembly 10 may include a single-piece tubular body 27 having a bore therethrough which may house the conductor 40. A lower end of tubular body 27 may include an overshot packer 18 sealably engaged about the upper end of a conductor 40. The upper end of tubular body 27 may further include one or more diverter flow outlets 13 in order to permit flowlines 44 to be connected thereto. The flowlines 44 connected to the diverter flow outlets 13 may direct fluids away from the rig. The upper end of tubular body 27 may further include one or more other outlets as may be desired. For example, but not by way of limitation, the upper end of tubular body 27 may include a mud pit outlet 26 adapted to permit flowlines 44 to be connected thereto to direct fluids to a mud pit (not shown). The upper end of tubular body 27 may further include a main packer 14, which may comprise an inwardly inflatable rubber sleeve. In certain embodiments, the main packer 14 may be inwardly contractible in response to the supply of fluid pressure to an outer side thereof.

As further shown in FIGS. 1 and 2, the diverter assembly 10 may be adapted to be mechanically coupled to the conductor 40 by an attaching means 21. Any suitable attaching means known to those of ordinary skill in the art may be used to couple the diverter assembly 10 to the conductor 40. For instance, the attaching means may include, but is not limited to actuator screws, dogs, slips, split rings, bolts, grips, threads, flanges, welding, or any other suitable attaching means known to those of ordinary skill in the art. For example, but not by way of limitation, the diverter assembly 10 may be mechanically attached to the conductor 40 by using an actuator screw mechanism 21 comprising a dog segment 22 and a ring 23. In addition, sealing elements 24 may be used to seal the diverter assembly 10 to the conductor 40. The figures show the diverter assembly 10 coupled to the conductor 40 by way of an actuator screw mechanism 21 on the lower tubular body 11. However, those skilled in the art will appreciate other suitable configurations may be used without departing from the scope of the present disclosure.

Referring now to FIG. 3, a drill string 19, having a drill bit 46 (shown in FIG. 3) at its lower end, may be directed downhole through the conductor 40 and used to perform drilling operations. In certain embodiments of the present disclosure, the diverter assembly 10 may include additional packer elements 15, 16 disposed within the upper tubular body 12 for sealing about a conduit during drilling operations. For instance, the conduit may be a drill string 19, as shown in the illustrative embodiment of FIG. 3, or a casing pipe 30, as shown in the illustrative embodiment of FIG. 4. In some embodiments of the present disclosure, a removable solid insert packer 15 may be lowered into and installed within the diverter assembly 10 adjacent to the main packer 14 of the upper tubular body 12, and may be releasably locked down by a locking means 17, located above the solid insert packer 15. Other types of locking means known to those of ordinary skill in the art may be used to lock down the removable solid insert packer 15. For instance, in certain embodiments, the locking means may be by latches, j-lugs, mechanical lock rings, or mechanical or hydraulic dogs or pins. In an embodiment as illustrated, additional removable packer elements 16 may be lowered into and installed within the diverter assembly 10, and also may be releasably locked down by locking means similar to those described in connection with the solid insert packer 15, also located above the packer elements. Any number of removable packer elements may be used without departing from the scope of the present disclosure. Moreover, as would be appreciated by those of ordinary skill in the art having the benefit of this disclosure, the number and size of the removable packer elements may depend on the size of the drill string 19 or casing pipe 30. When performing drilling operations, as shown in the embodiment of FIG. 3, the innermost packer element 16 may form a low pressure seal about the drill string 19 upon inflation of the main packer 14.

Referring now to FIG. 4, the drill string 19 may be removed and a casing pipe 30 may be run through the conductor 40 and diverter assembly 10. In certain embodiments, the casing pipe 30 may be cemented in place. In the embodiment of FIG. 4, the innermost packer element 15 may form a low pressure seal about the casing pipe 30 upon inflation of the main packer 14. As further shown in FIG. 4, in some embodiments of the present disclosure, the integral diverter system 20 may include only the main packer 14 and the solid insert packer 15, due to the increased size of the drill string 19 or casing pipe 30. One purpose of the packer elements is to permit the innermost packer element to form a low pressure seal about the drill string 19 or casing pipe 30 upon inflation of the main packer 14.

Figure 5:
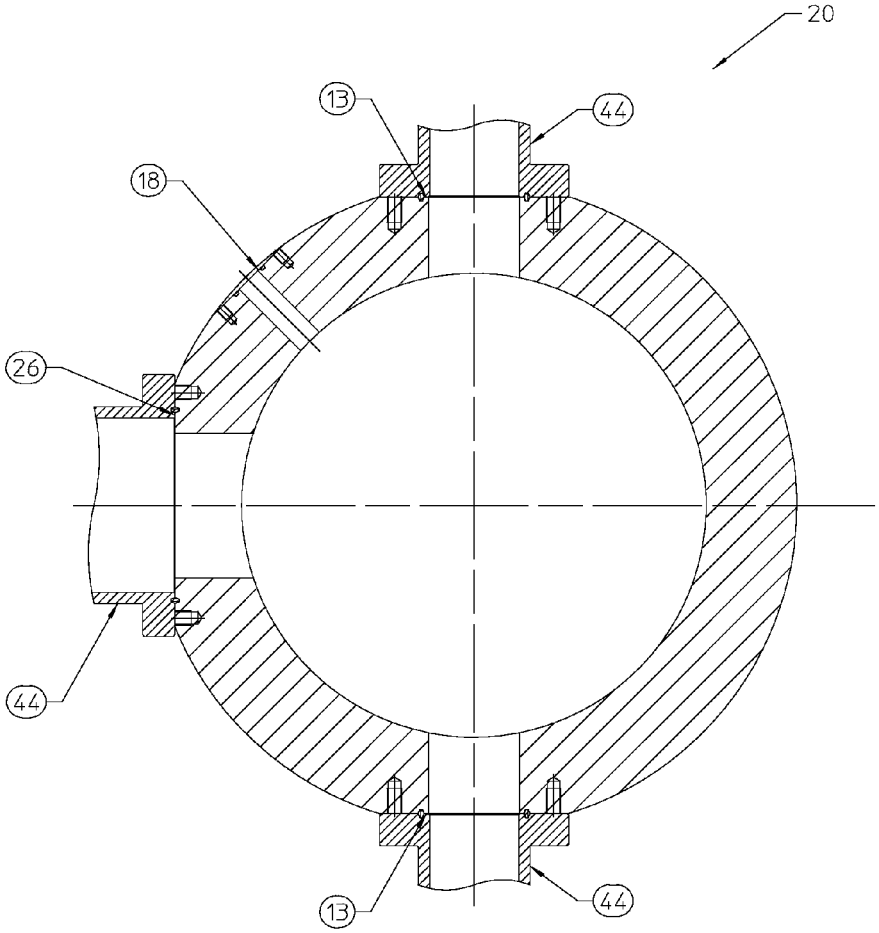
FIG. 5 illustrates a top cross-sectional view of an integral diverter system in accordance with certain embodiments of the present disclosure.

FIG. 5 shows a top, cross-sectional view of an integral diverter system 20 in accordance with certain embodiments of the present disclosure. As shown in FIGS. 1-4, the upper tubular body 12 or the upper end of tubular body 27 of the diverter assembly 10 may include the one or more diverter flow outlets 13 and one or more additional outlets as may be desired. The improved system of the present disclosure permits the one or more diverter flow outlets 13 and the one or more additional outlets 26 to be selectively opened or closed off, thus diverting the drilling fluid within the annulus between the drill string 19 or casing pipe 30 and the conductor 40 through the one or more additional outlets 26 or through the one or more diverter flow outlets 13.

Using the methods of certain embodiments of the present disclosure, coupling the diverter assembly 10 directly to the conductor 40 may allow for reduced costs associated with traditional diverter systems. In accordance with certain embodiments of the present disclosure, the diverter assembly 10 may be mechanically coupled directly to the conductor 40, avoiding any attachments to the drilling rig. Further in accordance with certain embodiments of the present disclosure, valves (not shown) and outlets 13, 26 may be located directly on the diverter assembly 10. In this manner, the integral diverter system 20 may eliminate the need for a housing and the costs associated with such a structure.

In addition, in certain embodiments of the present disclosure, the diverter assembly 10 including a lower tubular body 11 and an upper tubular body 12 may be used to accommodate various sizes of conductors 40. Specifically, the diameter of the bore of the lower tubular body 11 may vary in size to accommodate various sizes of conductors 40. In this manner, the lower tubular body 11 may be interchangeable.

In accordance with certain embodiments of the present disclosure, during normal operations, drilling fluid may be pumped down through the drill string 19 and returned to the surface through the annulus between the drill string 19 and the conductor 40. Further during normal operations, one or more diverter flow outlets 13 may be closed and the returned fluid may be directed to a mud pit through the mud pit outlet 26. In the event that an undesired condition occurs downhole (e.g., drill bit hits an area of shallow gas, etc.), the main packer 14 may be activated causing the innermost packer element to collapse on the portion of the drill string 19 that interfaces with the innermost packer element. Additionally, the diverter flow outlet(s) 13 may be opened and the mud pit outlet 26 may be closed. Accordingly, additional fluids may not be directed downhole because the main packer 14 has collapsed onto the drill string 19 and the unwanted fluids in the annulus between the drill string 19 and the conductor 40 (e.g., gas) may be directed out through the diverter flow outlet 13 and safely handled. Once the undesirable condition is handled, the main packer 14 may be deactivated and the conduit returns to original form. Additionally, diverter flow outlets 13 may be closed once again and the mud pit outlet 26 may be re-opened.

In certain implementations, the integral diverter system in accordance with the present disclosure may be used with land rigs. Further, because no housing is required, the integral diverter system may be used with existing land rigs without modification to the rig.

As would be appreciated by those of ordinary skill in the art, with the benefit of this disclosure, in certain implementations an integral diverter system in accordance with embodiments of the present disclosure may not mounted (i.e., permanently fixed) to the drilling rig. Therefore, unlike applications that utilize traditional diverter systems, the upward loads due to internal pressure traditionally transmitted to the bottom of the rig may be eliminated.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. For example, many of the features could be moved to different locations on respective parts without departing from the spirit of the invention. Furthermore, no limitations are intended to be limited to the details of construction or design herein shown, other than as described in the claims below. It is therefore evident that the particular illustrative embodiments disclosed above may be altered or modified and all such variations are considered within the scope and spirit of the present invention. Moreover, the indefinite articles "a" or "an", as used in the claims, are defined herein to mean one or more than one of the element that it introduces. Also, the terms in the claims have their plain, ordinary meaning unless otherwise explicitly and clearly defined by the patentee.

What is claimed is:

1. A diverter assembly for performance of subterranean operations comprising:

a lower tubular body, wherein the lower tubular body is operable to couple to a conductor;

an upper tubular body having one or more diverter flow outlets, and one or more additional outlets;

a connecting means, wherein the connecting means secures the lower tubular body to the upper tubular body;

a plurality of nested packer elements disposed within the upper tubular body; and locking means for securing the plurality of nested packer elements in position within the upper tubular body.

2. The diverter assembly of claim 1, wherein a diameter of a bore of the lower tubular body is different from a diameter of a bore of the upper tubular body.

3. The diverter assembly of claim 1, wherein the lower tubular body is interchangeable.

4. The diverter assembly of claim 1, further comprising one or more flowlines coupled to the one or more diverter flow outlets.

5. The diverter assembly of claim 1, further comprising one or more flowlines coupled to the one or more additional outlets.

6. The diverter assembly of claim 1, wherein the upper tubular body comprises a main packer having an inwardly inflatable rubber sleeve, wherein the inwardly inflatable rubber sleeve is inwardly contractible.

7. The diverter assembly of claim 1, wherein the connecting means is selected from a group consisting of one or more of actuator screws, dogs, slips, split rings, bolts, grips, threads, flanges, welding, and a combination thereof.

8. The diverter assembly of claim 1, wherein the locking means is selected from a group consisting of one or more of latches, j-lugs, mechanical lock rings, or mechanical or hydraulic dogs or pins, and a combination thereof.

9. A diverter assembly for performance of subterranean operations comprising:

a tubular body with a lower end and an upper end having an overshot packer at the lower end and one or more diverter flow outlets, one or more additional outlets, and a main packer at the upper end, wherein the tubular body is operable to couple to a conductor;

a plurality of nested packer elements at the upper end of the tubular body; and locking means for securing the plurality of nested packer elements in position within the upper end of the tubular body.

10. The diverter assembly of claim 9, further comprising one or more flowlines coupled to the one or more diverter flow outlets.

11. The diverter assembly of claim 9, further comprising one or more flowlines coupled to the one or more additional outlets.

12. The diverter assembly of claim 9, wherein the main packer comprises an inwardly inflatable rubber sleeve, wherein the inwardly inflatable rubber sleeve is inwardly contractible.

13. The diverter assembly of claim 9, wherein the locking means is selected from a group consisting of one or more of latches, j-lugs, mechanical lock rings, or mechanical or hydraulic dogs or pins, and a combination thereof.

14. An integral diverter system comprising:

a conductor extending upwardly from a wellhead;

a diverter assembly coupled to the conductor, the diverter assembly comprising:

a lower tubular body having an overshot packer, wherein the lower tubular body couples the conductor to the diverter assembly;

an upper tubular body having one or more diverter flow outlets, one or more additional outlets, and a main packer;

a connecting means, wherein the connecting means couples the lower tubular body to the upper tubular body;

a plurality of nested packer elements disposed within the upper tubular body;

locking means for securing the plurality of nested packer elements in position within the upper tubular body; and a conduit run through the conductor;

wherein the main packer comprises an inwardly inflatable rubber sleeve;

wherein the innermost packer element forms a low pressure seal about the conduit; and wherein a fluid flowing through an annulus between the conduit and the conductor or through the conduit may be selectively directed to at least one of the one or more diverter flow outlets and the one or more additional outlets.

15. The integral diverter system of claim 14, wherein the conduit is a drill string having a drill bit at a lower end of the drill bit.

16. The integral diverter system of claim 14, wherein the conduit is a casing pipe.

17. The integral diverter system of claim 14, a diameter of a bore of the lower tubular body is different from a diameter of a bore of the upper tubular body.

18. The integral diverter system of claim 14, wherein the lower tubular body is interchangeable.

19. The integral diverter system of claim 14, further comprising one or more flowlines coupled to the one or more diverter flow outlets.

20. The integral diverter system of claim 14, further comprising a flowline coupled to the one or more additional outlets.

21. The integral diverter system of claim 14, wherein the overshot packer sealingly engages about the upper end of the conductor.

22. The integral diverter system of claim 14, wherein the inwardly inflatable rubber sleeve of the main packer is inwardly contractible in response to supply of fluid pressure to an outside surface thereof.

23. The integral diverter system of claim 14, wherein the innermost packer element forms a low pressure seal about the conduit upon inflation of the main packer.

24. The integral diverter system of claim 14, wherein the system is adapted for use on a land rig.

25. An integral diverter system comprising:

a conductor extending upwardly from a wellhead;

a diverter assembly coupled to the conductor, the diverter assembly comprising:

a tubular body with a lower end and an upper end having an overshot packer at the lower end and one or more diverter flow outlets, one or more additional outlets, and a main packer at the upper end, wherein the tubular body is operable to couple to a conductor;

a plurality of nested packer elements at the upper end of the tubular body; and locking means for securing the plurality of nested packer elements in position within the upper end of the tubular body;

a conduit, wherein the conduit runs through the conductor;

wherein the main packer comprises an inwardly inflatable rubber sleeve;

wherein the innermost packer element forms a low pressure seal about the conduit; and wherein a fluid flowing through the conduit or an annulus between the conduit and the conductor may be selectively directed to at least one of the one or more diverter flow outlets and the one or more additional outlets.

26. The integral diverter system of claim 25, wherein the conduit is selected from a group consisting of a drill string and a casing pipe.

27. The integral diverter system of claim 25, further comprising one or more flowlines coupled to the one or more diverter flow outlets.

28. The integral diverter system of claim 25, further comprising one or more flowlines coupled to the one or more additional outlets.

29. The integral diverter system of claim 25, wherein the overshot packer sealingly engages about the upper end of the conductor.

30. The integral diverter system of claim 25, wherein the inwardly inflatable rubber sleeve of the main packer is inwardly contractible in response to supply of fluid pressure to an outside surface thereof.

31. The integral diverter system of claim 25, wherein the innermost packer element forms a low pressure seal about the conduit upon inflation of the main packer.

32. The integral diverter system of claim 25, wherein the integral diverter system is coupled to a land rig.

* * * * *